US011292641B2

(12) United States Patent
Mühlemann

(10) Patent No.: US 11,292,641 B2
(45) Date of Patent: Apr. 5, 2022

(54) PLASTIC CLOSURE FOR A CONTAINER HAVING AN INTEGRITY GUARANTEE ELEMENT

(71) Applicant: Mühlemann IP GmbH, Stein am Rhein (CH)

(72) Inventor: Rolf Mühlemann, Schlattingen (CH)

(73) Assignee: MÜHLEMANN IP GMBH, Stein am Rhein (CH)

( * ) Notice: Subject to any disclaimer, the term of this patent is extended or adjusted under 35 U.S.C. 154(b) by 192 days.

(21) Appl. No.: 16/341,119

(22) PCT Filed: Oct. 5, 2017

(86) PCT No.: PCT/EP2017/075376
§ 371 (c)(1),
(2) Date: Apr. 11, 2019

(87) PCT Pub. No.: WO2018/069153
PCT Pub. Date: Apr. 19, 2018

(65) Prior Publication Data

US 2020/0180824 A1 Jun. 11, 2020

(30) Foreign Application Priority Data

Oct. 12, 2016 (CH) ..... 01366/16

(51) Int. Cl.
*B65D 47/08* (2006.01)
*B65D 50/00* (2006.01)

(52) U.S. Cl.
CPC ..... *B65D 47/0838* (2013.01); *B65D 50/00* (2013.01); *B65D 2251/1025* (2013.01); *B65D 2401/15* (2020.05); *B65D 2401/60* (2020.05)

(58) Field of Classification Search
CPC ..... B65D 47/0838; B65D 50/00; B65D 2401/15; B65D 2401/60; B65D 2251/1025
(Continued)

(56) References Cited

U.S. PATENT DOCUMENTS 4,696,408 A 9/1987 Dubach
5,497,906 A 3/1996 Dubach
(Continued)

FOREIGN PATENT DOCUMENTS

CN 1675108 A 9/2005
CN 105073592 A 11/2015
(Continued)

OTHER PUBLICATIONS

Third party Observation for PCT/EP17/75376, submitted Nov. 21, 2018 (machine translation).
(Continued)

*Primary Examiner* — J. Gregory Pickett
*Assistant Examiner* — Niki M Eloshway
(74) *Attorney, Agent, or Firm* — Paul D. Bianco; Katherine Davis; Fleit Intellectual Property Law

(57) ABSTRACT

A plastic closure includes a lower part, a lid, integrally connected to the lower part via a hinge, and at least one integrity guarantee element to indicate if the plastic closure has ever been opened. The plastic closure further includes at least one first detent element and at least one second detent element, and the at least one first detent element forms at least one integrity guarantee element and in the closed state and before the plastic closure is opened for the first time is in engagement with the at least one second detent element. The first detent element has a predetermined breaking point, and, when the plastic closure is opened for the first time via a pivoting movement of the lid, the predetermined breaking point can be broken and at least one part of the first detent element is configured to swing out to release the second detent element.

16 Claims, 3 Drawing Sheets

(58) Field of Classification Search
USPC ..... 220/254.3, 265; 215/250
See application file for complete search history.

(56) References Cited

U.S. PATENT DOCUMENTS

| | | | | |
|---|---|---|---|---|
| 7,611,025 | B2 | 11/2009 | Nusbaum et al. | |
| 9,850,044 | B2 | 12/2017 | Mühlemann | |
| 9,884,706 | B1 * | 2/2018 | Skillin | B65D 47/18 |
| 2006/0043052 | A1 * | 3/2006 | Lin | B65D 47/0838 215/253 |
| 2009/0152269 | A1 | 6/2009 | Pucci | |
| 2011/0108509 | A1 * | 5/2011 | Fontana | B65D 55/024 215/228 |
| 2014/0263474 | A1 * | 9/2014 | Skillin | B65D 75/5883 222/541.9 |
| 2014/0312038 | A1 * | 10/2014 | van Alfen | B65D 43/16 220/214 |
| 2014/0346172 | A1 | 11/2014 | Banerjee et al. | |
| 2016/0016703 | A1 * | 1/2016 | Muhlemann | B65D 47/0814 222/566 |
| 2016/0368674 | A1 * | 12/2016 | Ferrari | B65D 55/024 |
| 2019/0177044 | A1 * | 6/2019 | Beringer | B65D 75/5883 |
| 2020/0156829 | A1 * | 5/2020 | Pristera | B65D 41/3428 |
| 2020/0331668 | A1 * | 10/2020 | Gonzalez Sanchez | B65D 51/007 |

FOREIGN PATENT DOCUMENTS

| | | | |
|---|---|---|---|
| EP | 0210138 | A2 | 1/1987 |
| EP | 1619135 | A1 | 1/2006 |
| GB | 2269583 | A | 2/1994 |
| WO | 94/03371 | A1 | 2/1994 |
| WO | 98/57864 | A1 | 12/1998 |
| WO | 00/41943 | A1 | 7/2000 |
| WO | 2012/175663 | | 12/2012 |
| WO | 2014/139767 | A2 | 9/2014 |

OTHER PUBLICATIONS

International Preliminary Report dated Apr. 16, 2019, for PCT/EP2017/075376, with English translation of the Written Opinion.
International Search Report dated Dec. 1, 2017 for PCT/EP2017/075376 filed Oct. 5, 2017.
Written Opinion for PCT/EP2017/075376 filed Oct. 5, 2017.
First Office Action for Chinese Patent No. 2020070102308330 dated Jul. 6, 2020.

* cited by examiner

PLASTIC CLOSURE FOR A CONTAINER HAVING AN INTEGRITY GUARANTEE ELEMENT

TECHNICAL FIELD

The invention relates to a plastic closure comprising a lower part and a lid, which is integrally connected to the lower part via a hinge, what are known as flip-top closures. The plastic closure also comprises an integrity guarantee element to indicate when the lid has been opened for the first time.

TECHNICAL BACKGROUND

Plastic closures which have a lower part and a lid connected thereto via a hinge, what are known as flip-top closures, must be secured such that the consumer can tell whether the closure has already been opened before purchase.

Accordingly, plastic closures which have integrity guarantee elements have also already been known for many years. The best known form of an integrity guarantee element is the guarantee band, which originally produced a connection between the plastic closure and the container to which the plastic closure is attached. Such a guarantee band is sufficient for a screw closure, of course. Such a guarantee band can also be used for plastic closures with a hinge, in the case of which the lower part can be connected fixedly to the container neck; in this case such a guarantee band usually does not run all the way round. An example is known from EP0210138. Before such a plastic closure can be opened, the guarantee band must first be torn off.

For ease of use, integrity guarantee elements were then developed which, when the hinged closure is opened for the first time, automatically effect a separation of the integrity guarantee element from the part to which this integrity guarantee element is connected via predetermined breaking points. Such a plastic closure is disclosed in WO9403371, for example. In this case, a plate is held in the top surface of the lid, flush with the top surface, via predetermined breaking bridges, and on the lower side thereof an arm is formed with a terminal locking hook which is associated with a mating locking hook on the lower part. Accordingly, on opening for the first time, the plate of the integrity guarantee element is torn out of the top surface of the lid and then falls onto the top surface of the lower part. This provides a clearly visible integrity guarantee. In addition, such a solution has the advantage that, once opened, it is practically impossible to tamper with the integrity guarantee element in order to restore the state of integrity.

WO0041943 discloses a solution of an integrity guarantee element which is likewise difficult to tamper with. In this case, the integrity guarantee element consists of a completely separate guarantee band which engages with the lid and the lower part via protruding beads. Such a solution has the advantage that the guarantee band can be made in a different colour from the plastic closure itself and is thus easily visible. In this case, as in currently customary solutions with integrity guarantee elements, the separated parts are relatively large, and these integrity guarantee elements are torn off and carelessly discarded, especially in the case of beverages which are provided with a plastic closure with a drinking spout.

A solution in which the integrity guarantee element is not a separate, loose part is disclosed in GB2269583, for example. In this case, the plastic closure is provided with a shield-shaped tilting plate, which hooks pivotably into the lower part. For opening, pressure is applied to this shield-shaped plate, destroying a predetermined breaking bridge. The closure can then be opened. However, this solution has the problem that it either is likewise completely removed and discarded or, if not completely removed, remains in the vicinity of the drinking spout and limits the accessibility thereof.

WO9857864 discloses a plastic closure which has an integrity guarantee element formed on the lateral wall of the lid, said integrity guarantee element being intended to engage in a niche in the lateral wall of the lower part. In this case, the integrity guarantee element pivots about the predetermined breaking points and has two plugs which are intended to engage in corresponding holes in the lateral wall of the lower part. In addition, a tilting rib is formed in the niche in the lower part, and the user should press on the integrity guarantee element, resulting in a tilting movement over the tilting rib and the integrity guarantee element separating from the lid. The closure can then be pivoted open. This closure is problematic in that the user does not recognise the function and in principle attempts to lift off the integrity guarantee element. Furthermore, a pivoting movement about an arcuate hinge is extremely problematic, and it has ultimately been found that such a closure can be handled on conventional assembly machines only with extreme difficulty and that a significant percentage of the closures are destroyed in the process.

US2009152269 and WO2014139767 disclose further plastic closures having integrity guarantee elements. In each case, the integrity guarantee element comprises a locking hook and hook catch windows. The locking hook is connected to the lid via predetermined breaking points and is caught in the hook catch window when in the closed state. On opening for the first time, the locking hook is torn off. In the case of the plastic closure of US2009152269, the locking hook falls off on opening and therefore is not usually disposed of properly. In the case of the plastic closure of WO2014139767, the locking hook is secured against falling off. However, it can still be pulled out of the hook catch window more or less easily and therefore at most cannot meet the strict standards relating to safety for small children.

SUMMARY

One aspect of the present invention relates to a plastic closure having an integrity guarantee element which does not have the above problems. In particular, the plastic closure should meet the safety standards for small children, be simple to produce in one piece, and be simple to close in a conventional manner in common assembly machines with a low number of rejects.

In an embodiment, the plastic closure comprises a lower part, a lid, which is integrally connected to the lower part via a hinge, and at least one integrity guarantee element to indicate if the plastic closure has ever been opened. The plastic closure further comprises at least one first detent means and at least one second detent means, and the at least one first detent means forms at least one integrity guarantee element and in the closed state and before the plastic closure is opened for the first time is in engagement with the at least one second detent means. The first detent means has a predetermined breaking point, and, when the plastic closure is opened for the first time via a pivoting movement of the lid, the predetermined breaking point can be broken and at least one part of the first detent means is configured to pivot out to release the second detent means.

In this manner, the individual parts of the integrity guarantee element remain on the plastic closure even after the predetermined breaking point has been broken, i.e. The first detent means preferably has a single predetermined breaking point. Undesirable falling off is prevented, and therefore such a plastic closure also meets high safety standards for small children. Opening for the first time is still detectable simply owing to the breaking point and a deformation, occurring on bending, of the part which can pivot out. The pivoted-out part cannot be simply bent back into the original position. A further advantage consists in the possibility of simple production by injection-moulding and simple mounting on the container to be closed.

The terms top and bottom relate to a plastic closure in the closed state in which the lid is at the top and the lower part is at the bottom. Furthermore, a longitudinal axis extends centrally through the closed plastic closure from top to bottom.

In some embodiments, the first detent means can have at least one bending point about which the at least one part of the first detent means can be pivoted out. In this case, the bending point can be a region of the first detent means which is most deformed on opening for the first time. Such a deformation can be assisted by a notch, narrowed portion or other way of weakening the bending point to produce a localised bending point.

In some embodiments, the first detent means can be a hook catch window with a transverse connecting piece, and the second detent means can be a locking hook which engages in the hook catch window and catches against the transverse connecting piece when the plastic closure is in the closed state. In this case, the transverse connecting piece can, for example, be sufficiently flexible for at least one part of the transverse connecting piece to be able to pivot out after the predetermined breaking point is broken. In other embodiments, the pivoting out can take place by means of localised bending points. In this case, in some variants, the transverse connecting piece can have the predetermined breaking point at one end, in the vicinity of one end or centrally between the two ends.

In some embodiments, the second detent means can be designed such that a force is transferred from the second detent means to the first detent means in the region of the predetermined breaking point on opening for the first time. For instance, if the predetermined breaking point is arranged centrally, a locking hook can have a projection which points towards the predetermined breaking point and initially presses onto the predetermined breaking point on opening for the first time, thus making it easy to break open.

If bending points are provided, they are preferably arranged such that the parts of the transverse connecting piece can pivot out about the bending point unhindered to release the second locking means. For example, a bending point is arranged on the end opposite the predetermined breaking point, or, if the predetermined breaking point is arranged centrally, one bending point is arranged at each of the two ends. In all cases, whether with or without a localised bending point, the transverse connecting piece will break at the predetermined breaking point and one or more parts are pivoted out to release the second detent means when the plastic closure is opened for the first time.

In some embodiments, the bending point or the location of the bending point can be formed by a weakening in the wall thickness of the transverse connecting piece.

In some embodiments, the first detent means is arranged on the lid or on the lower part, and the second detent means is conversely arranged on the lower part or on the lid.

In some embodiments, the lower part can comprise a cylindrical lateral wall which can be closed off on the upper side by a top surface, with a circumferential shoulder, which is set downwards relative to the top surface, being formed at the upper end of the lateral wall.

On the shoulder and in the extension of the lateral wall, an upwardly pointing first skirt can be formed, which can extend at least along a portion of the lateral wall, the first skirt having the first detent means. The first skirt can have a smaller wall thickness than the radial extent of the shoulder, so that a lateral wall of the lid can be supported on the shoulder of the lower part when the plastic closure is in the closed state.

In some embodiments, there can be in the region of the at least one first detent means at least one concentric, inner skirt, which is offset inwards towards the centre of the plastic closure; the inner skirt can preferably have at least one guide rib on the outer side thereof. These guide ribs make it easier to close the plastic closure correctly, in particular during initial closing by machine, by guiding an inwardly offset region of a lateral wall of the lid exactly in position, for example.

In some embodiments, the lid can comprise a top surface and a peripheral, preferably circumferential lateral wall which is supported on the lower part when the plastic closure is in the closed state. Preferably, the lateral wall of the lid rests on the top surface or the shoulder of the lower part when the plastic closure is in the closed state.

In some embodiments, the lateral wall of the lid can be arranged offset inwards towards the centre in the region of the first skirt in relation to the lateral wall of the lower part and relative to an outer edge of the top surface of the lid by slightly more than the wall thickness of the first skirt of the lower part. In this manner, the lateral wall can rest on the shoulder of the lower part behind the first skirt when the plastic lid is in the closed state. The lateral wall of the lid can have the at least one second detent means. The at least one second detent means can be separated from the rest of the lateral wall of the lid by means of slots on both sides. In this manner, sufficient flexibility of the second detent means when catching in the first detent means during first closing can be ensured.

BRIEF DESCRIPTION OF THE DRAWINGS

The invention is explained in more detail below using exemplary embodiments in conjunction with the drawing(s). In the figures.

EMBODIMENTS OF THE INVENTION

Figure 1:
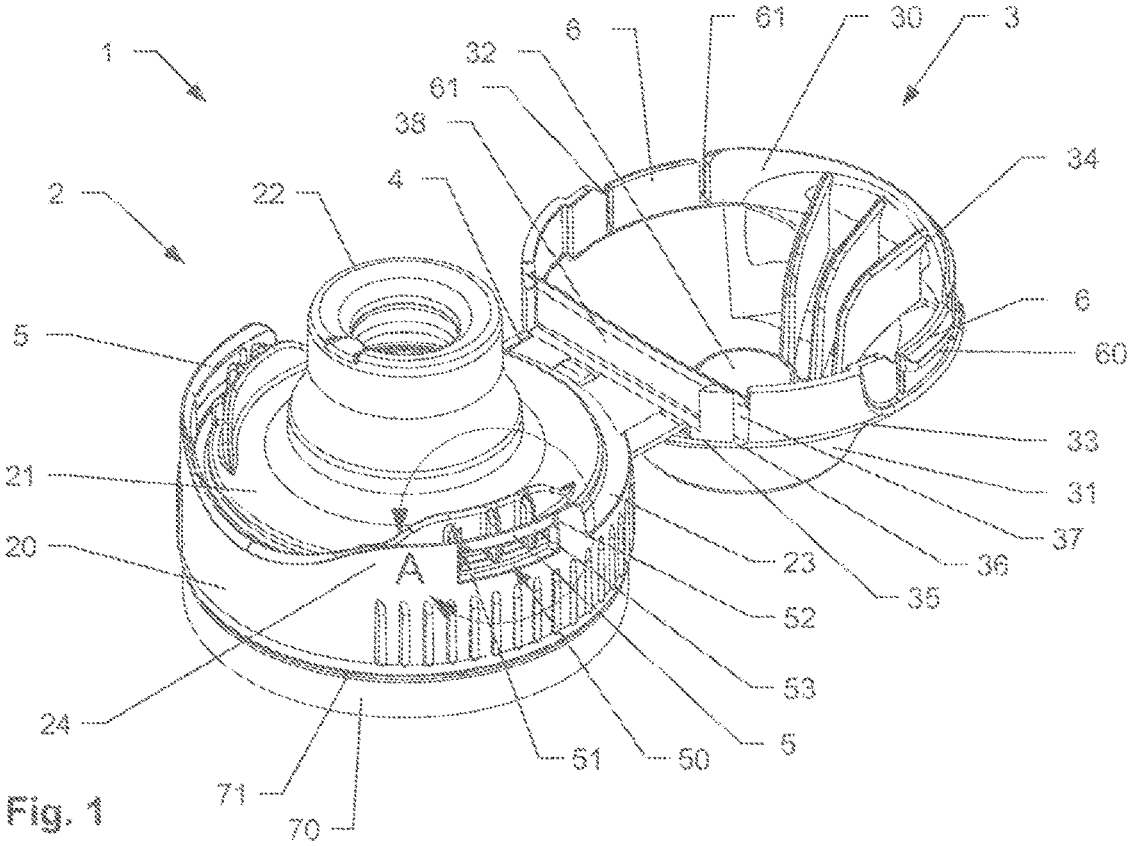
FIG. 1 shows a perspective view of an open plastic closure.
Figure 2:
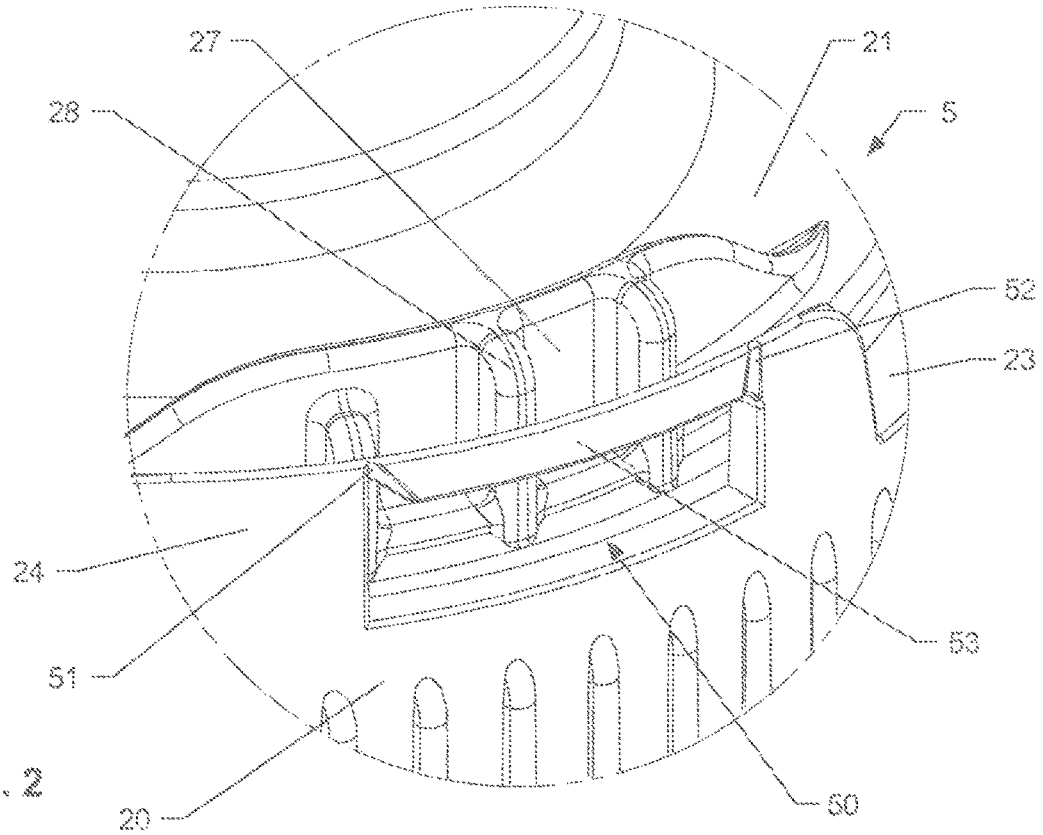
FIG. 2 shows a detail A of the integrity guarantee element of FIG. 1.
Figure 3:
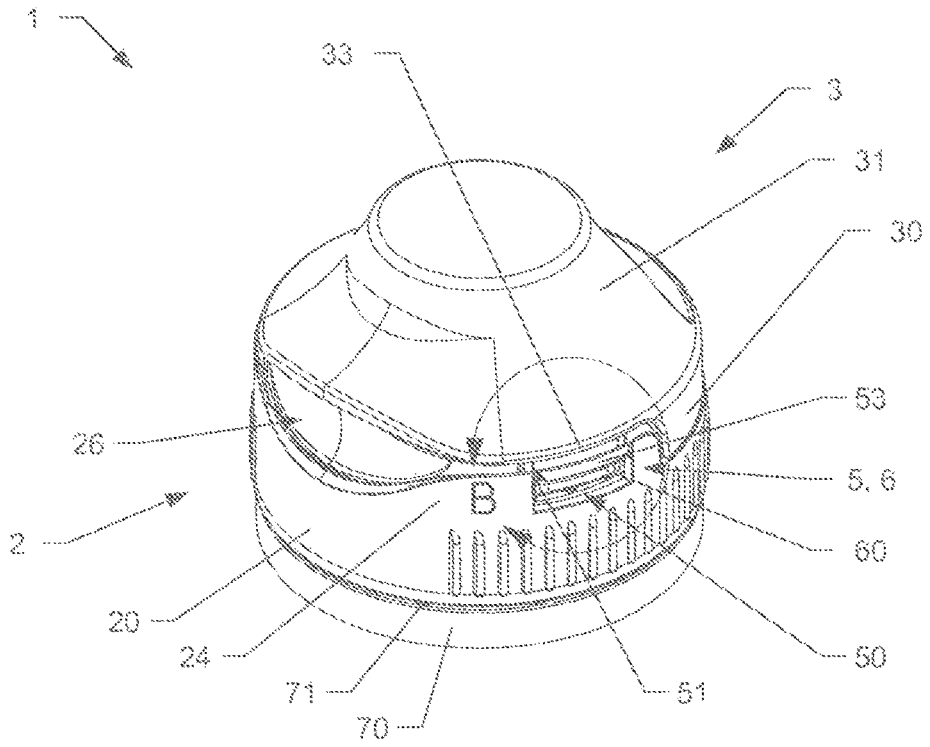
FIG. 3 shows a perspective view of a closed plastic closure.
Figure 4:
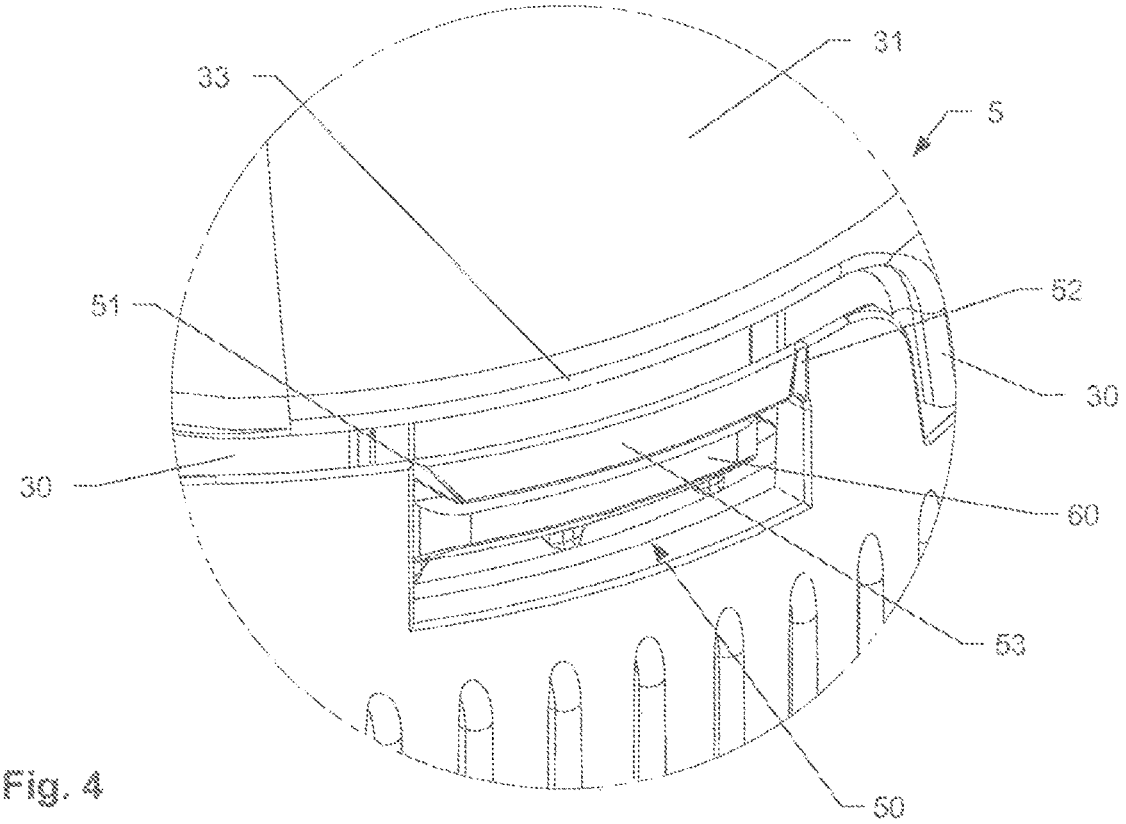
FIG. 4 shows a detail B of the integrity guarantee element of FIG. 3.

FIGS. 1 to 4 show an embodiment of a plastic closure 1 having an integrity guarantee element in a perspective view and in a detail view (regions A and B of FIG. 1 and FIG. 3, respectively), in each case in the open and closed state of the plastic closure.

The plastic closure as a whole is denoted with 1. It consists of a lower part 2 and a lid 3. The lower part 2 and the lid 3 are connected integrally to each other via a hinge 4. In the embodiment shown, the hinge is a snap hinge. Other hinge types are also possible. The plastic closure is preferably produced integrally in the open state by injection-moulding.

The lower part 2 has a cylindrical lateral wall 20 which is terminated on the upper side by a top surface 21. A sealing skirt (not visible in the figures) is also present on the inside of the top surface 21. The plastic closure is held sealingly on a container neck by means of the lateral wall 20 and the sealing skirt.

A drinking spout 22 also passes through this top surface 21 and protrudes from the top surface 21 approximately by the height of the lateral wall 20. The drinking spout 22 can be designed in virtually any desired manner. In the embodiment shown, the drinking spout 22 tapers upwards with a certain conicity. The drinking spout is likewise arranged in the centre of the lower part, i.e. Concentrically around the longitudinal axis of the plastic closure, in the embodiment shown. An eccentric arrangement is also possible, in which the drinking spout is preferably arranged further away from the hinge.

The top surface 21 can be substantially flat and adjoins the lateral wall 20 such that a circumferential shoulder 23, which is offset downwards relative to the top surface 21, i.e. towards the container, is formed on the upper end of the lateral wall 20.

In the embodiment shown, an upwardly pointing first skirt 24 is formed on the shoulder 23 and in the extension of the lateral wall 20, extends along a portion of the lateral wall 20 over approximately 180 degrees and is arranged opposite the hinge 4. Alternatively, said skirt can be in the form of two individual skirts. The wall thickness of the first skirt 24 is smaller than the radial extent of the shoulder 23, so that a circumferential lateral wall of the lid 3 can be supported on the shoulder 23 when the plastic closure is in the closed state. The height of the first skirt 24 is only a few millimetres and is approximately a third as high as the drinking spout 22. Approximately in the centre, opposite the hinge, the first skirt 24 is provided on the upper edge with a recess 25 which forms a grip niche 26. To the side of this grip niche 26, two first detent means 5 in the form of hook catch windows 50 are formed in the first skirt 24 and form the integrity guarantee element for indicating when the plastic closure 1 has been opened for the first time. These are rectangular holes in the first skirt 24. In principle, one hook catch window could be made in the middle instead of the two hook catch windows. However, since the grip niche is provided in this region, the remaining wall height is somewhat low and therefore it is preferred to make the two hook catch windows 50 to the side. In the embodiment shown, the two hook catch windows 50 are each delimited by a transverse connecting piece 53 which has a predetermined breaking point 51 at one end and a bending point 52 at the other end.

An inner skirt 27 is provided concentrically to the first skirt 24 in the region of the first detent means 5. The significance and operating principle of this is explained below. These inner skirts 27 are of approximately equal height to the first skirt in the region of the first detent means 5. The inner skirts are offset radially inwards and arranged on the top surface 21 of the lower part 2.

The lid 3 also has a top surface 31, which is approximately in the form of a truncated cone with slightly concave side walls. A sealing plug 32, which can be introduced sealingly into the drinking spout 22, is formed on the inside of the top surface 31 of the lid 3. Said sealing plug has a substantially hollow cylindrical shape. The lid 3 also has a peripheral, circumferential lateral wall 30, which is arranged offset inwards towards the centre in the region of the first skirt 24 in relation to the lateral wall 20 of the lower part 2 and relative to the edge 33 of the top surface 31 of the lid 3 by slightly more than the wall thickness of the first skirt 24 of the lower part 2, so that it rests there on the shoulder 23 of the lower part 2 when the plastic closure is in the closed state.

In the lateral wall 30 of the lid 3 there are second detent means 6 in the form of locking hooks 60 in the region of the first detent means 5 on the lower part 2. As shown in the illustrated embodiment, the locking hooks can be separated from the rest of the lateral wall 30 by means of slots 61 on both sides so that they have sufficient flexibility for closing the plastic closure 1 for the first time. The locking hook 60 engages in the hook catch window 50 under the transverse connecting piece 53 when the plastic closure 1 is in the closed state.

In addition to forming the first detent means 5, the first skirt 24 simultaneously forms a screen to cover the region of the lateral wall 31 of the lid 3 which is offset towards the centre.

The shorter inner skirts 27 running concentrically to the first skirt closer to the centre have other functions. Firstly, they ensure that, during mechanical closing for the first time, the inwardly offset region of the lateral wall is guided exactly in position and in the process the locking hooks 60 are guided exactly in front of the hook catch windows 50 and are displaced in that direction far enough for the locking hooks 60 to fit into these hook catch windows 50. To this end, multiple guide ribs 28, which are arranged substantially parallel to the longitudinal axis of the plastic closure, can be present on the inner skirts 27. In the embodiment shown, there are three in each case. At the same time, however, the inner skirts prevent tampering with the integrity guarantee element. The locking hooks 60 therefore cannot be pushed inwards from the outside to disengage them from the hook catch windows 50. The integrity guarantee element can therefore only be destroyed by opening the plastic closure 1, that is, pivoting the lid 3 relative to the lower part 2 about the hinge 4. If such a first opening takes place, the said predetermined breaking points 51 are destroyed and the respective transverse connecting piece 53 pivots upwards and/or outwards about the bending region 52 to release the respective locking hook 60. The transverse connecting piece 53 partially separated and pivoted-out in this manner can easily be seen and indicates that opening has taken place for the first time.

When the plastic closure is closed again, the lid 3 is held on the lower part 2 via the sealing plug 32 in the drinking spout 22 and via supporting ribs 34 which are formed on the inside of the lid 3 and are pressed against the drinking spout 22 when in the closed state.

To increase the drinking comfort of the plastic closure 1, a film hinge 36 is present over a segment 35 of the lid 3 and separates the segment 35 from the rest of the lid 3 in a pivotable manner. Correspondingly, the lateral wall 30 has slots 37 in the region of the film hinge 36. For hygiene reasons, a partition 38 runs along the inside of the film hinge 36 in the region of the segment 35 and rests on the top surface 21 of the lower part 2 in the closed state. The pivotable segment 35 allows the user to pivot this lid part away from the drinking spout 22 about the film hinge 36 with a finger for drinking, so that the lid 3 is not in the way during drinking.

The lower part 2 can also be connected to a securing ring 70 via predetermined breaking bridges 71 on the lower edge of the lateral wall 20. This securing ring 70 allows the closed plastic closure 1 on the container to be simply pushed open. To this end, inwardly pointing retaining beads (not visible in the drawing), which can be brought into engagement on a circumferential retaining bead on the container neck, are formed on the inside. This also ensures that the closure 1 cannot be removed from the container neck in the closed state without being noticed. The lateral wall 20 can also have an internal thread which is complementary to the container neck. When the predetermined breaking bridges 71 are destroyed, the securing ring 70 slides to a lower level, and a customer can clearly see that the container has already been opened.

Figure 5A:
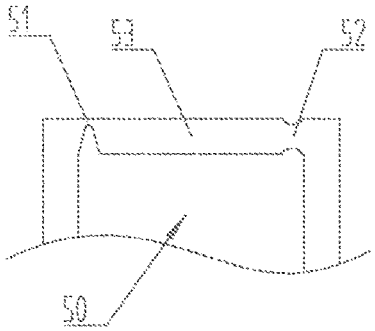
FIG. 5 shows a schematic diagram of an embodiment of the integrity guarantee element in the intact state (a) and in the broken state (b)
Figure 5B:
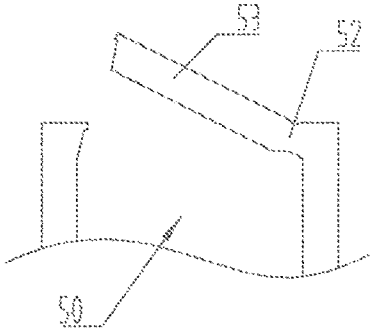
Figure 6A:
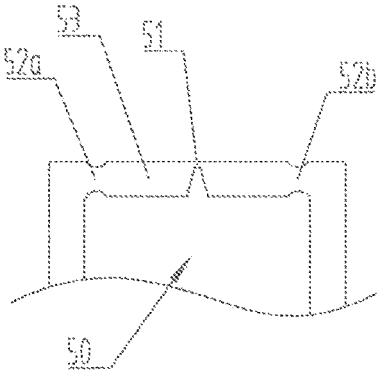
FIG. 6 shows a schematic diagram of a further embodiment of the integrity guarantee element in the intact state (a) and in the broken state (b).
Figure 6B:
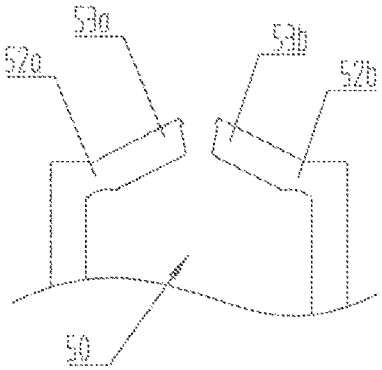

FIGS. 5 and 6 show two embodiments of the integrity guarantee element to illustrate the first time the plastic closure 1 is opened in a schematic diagram, in each case (a) in the intact state and (b) in the broken state.

In the embodiment of FIG. 5, the integrity guarantee element or the first detent means 5 is in the form of a hook catch window 50 and has a transverse connecting piece 53 delimiting the hook catch window 50. There is a predetermined breaking point 51 at one end of the transverse connecting piece 53. At the other end of the transverse connecting piece 53 there is an optional bending point 52 localised by a weakened portion of the transverse connecting piece 53. When the plastic closure is opened for the first time, the predetermined breaking point 51 and the transverse connecting piece 53 pivots about the bending point 52 to release the second detent means 6 in the form of a locking hook (not shown). This embodiment corresponds substantially to the design in FIGS. 1 to 4.

In contrast to the embodiment of FIG. 5, the transverse connecting piece 53 of the embodiment of FIG. 6 has in each case a localised bending point 52*a*, 52*b* on both sides, and the predetermined breaking point 51 is arranged centrally in the transverse connecting piece 53. When the plastic closure is opened for the first time, the transverse connecting piece 53 breaks at the centrally arranged predetermined breaking point 51 into two parts, which pivot about the respective bending points 52*a*, 52*b* to release the second detent means 6 in the form of a locking hook (not shown).

LIST OF REFERENCE SIGNS

1 Plastic closure
2 Lower part
3 Lid
4 Hinge
5 First detent means
6 Second detent means
20 Lateral wall
21 Top surface
22 Drinking spout
23 Circumferential shoulder
24 First skirt
25 Recess
26 Grip niche
27 Inner skirt
28 Guide ribs
30 Lateral wall
31 Top surface
32 Sealing plug
33 Edge
34 Supporting ribs
35 Segment
36 Film hinge
37 Slot
38 Partition
50 Hook catch window
51 Predetermined breaking point
52 Bending point
53 Transverse connecting piece
60 Locking hook
61 Slot
70 Securing ring
71 Predetermined breaking bridges

The invention claimed is:

1. A closure for a container comprising:

a lower part including a cylindrical lateral wall terminated on an upper side by a top surface and a circumferential shoulder formed on an upper end of the cylindrical lateral wall and downwardly offset relative to the top surface;

a lid integrally connected to the lower part by a hinge;

at least one integrity guarantee element configured for indicating if the closure has been opened, the at least one integrity guarantee element formed by at least one first detent element engaged with at least one second detent element when in a closed configuration prior to a first opening of the closure; and an upwardly pointing first skirt extending along at least a portion of the cylindrical lateral wall and including the at least one first detent element, the upwardly pointing first skirt formed on the circumferential shoulder and in an extension of the lateral wall, wherein, when the closure is opened for a first time via a pivoting movement of the lid relative to the lower part, a predetermined breaking point in the at least one first detent element is broken and at least one part of the at least one first detent element pivots outwardly releasing the at least one second detent element.

2. The closure according to claim 1, further comprising at least one bending point on the at least one first detent element from which the at least one part of the at least one first detent element pivots outwardly.

3. The closure according to claim 2, wherein the at least one first detent element is a hook catch window delimited by a transverse connecting piece and the at least one second detent element is a locking hook, the locking hook engaging the hook catch window catching against the transverse connecting piece when the closure is in the closed configuration.

4. The closure according to claim 3, wherein the predetermined breaking point is at one end of the transverse connecting piece or is centrally located between two ends of the transverse connecting piece.

5. The closure according to claim 3, wherein the at least one bending point is formed by a weakening of a thickness of a wall of the transverse connecting piece.

6. The closure according to claim 1, wherein the predetermined breaking point is a single predetermined breaking point.

7. The closure according to claim 1, wherein the at least one second detent element is configured such that force is transferred from the at least one second detent element to the at least one first detent element during a first opening of the closure.

8. The closure according to claim 1, wherein the at least one first detent element is arranged on the lid or on the lower part and the at least one second detent element is conversely arranged on the lower part or on the lid.

9. The closure according to claim 1, wherein a thickness of a wall of the upwardly pointing first skirt is smaller than a radial extent of the circumferential shoulder.

10. The closure according to claim 1, further comprising a concentric inner skirt in an area of the at least one first detent element, the concentric inner skirt inwardly offset towards a center of the closure.

11. The closure according to claim 10, wherein the concentric inner skirt comprises at least one guide rib on an outer side.

12. The closure according to claim 10, wherein the lid comprises a top surface and a peripheral lateral wall, the peripheral lateral wall resting on the lower part when the closure is in the closed configuration.

13. The closure according to claim 12, wherein the peripheral lateral wall of the lid is inwardly offset towards the center of the closure in an area of the first skirt in relation to the cylindrical lateral wall of the lower part and relative to an outer edge of the top surface of the lid by more than thickness of a wall of the first skirt of the lower part.

14. The closure according to claim 12, wherein the peripheral lateral wall of the lid comprises the at least one second detent element.

15. A closure for a container comprising:

a lower part including a cylindrical lateral wall terminated on an upper side by a top surface and a circumferential shoulder formed on an upper end of the cylindrical lateral wall and downwardly offset relative to the top surface;

a lid comprising a top surface and a peripheral lateral wall, the peripheral lateral wall resting on the lower part when the closure is in the closed configuration and the lid integrally connected to the lower part by a hinge;

at least one integrity guarantee element configured for indicating if the closure has been opened, the at least one integrity guarantee element formed by at least one first detent element engaged with at least one second detent element when in a closed configuration prior to a first opening of the closure; and an upwardly pointing first skirt extending along at least a portion of the cylindrical lateral wall, the upwardly pointing first skirt formed on the circumferential shoulder and in an extension of the cylindrical lateral wall, wherein the peripheral lateral wall of the lid comprises the at least one second detent element;

wherein, when the closure is opened for a first time via a pivoting movement of the lid relative to the lower part, a predetermined breaking point in the at least one first detent element is broken and at least one part of the at least one first detent element pivots outwardly releasing the at least one second detent element; and wherein the at least one second detent element is separated from the peripheral lateral wall by slots on both sides.

16. A closure for a container comprising:

a lower part including a cylindrical lateral wall terminated on an upper side by a top surface and a circumferential shoulder formed on an upper end of the cylindrical lateral wall and downwardly offset relative to the top surface;

a lid integrally connected to the lower part by a hinge;

at least one integrity guarantee element configured for indicating if the closure has been opened, the at least one integrity guarantee element formed by at least one first detent element engaged with at least one second detent element when in a closed configuration prior to a first opening of the closure; and an upwardly pointing first skirt extending along at least a portion of the cylindrical lateral wall, the upwardly pointing first skirt formed on the circumferential shoulder and in an extension of the cylindrical lateral wall;

wherein, when the closure is opened for a first time via a pivoting movement of the lid relative to the lower part, a predetermined breaking point in the at least one first detent element is broken and at least one part of the at least one first detent element is pivoted outwardly from the lower part releasing the at least one second detent element.

* * * * *